US005573479A

United States Patent [19]

Harris

[11] Patent Number: 5,573,479

[45] Date of Patent: Nov. 12, 1996

[54] FINGER EXERCISING APPARATUS

[76] Inventor: Clyde T. Harris, 131 S. Bay Way, Port Ludlow, Wash. 98365

[21] Appl. No.: 290,066

[22] Filed: Aug. 15, 1994

[51] Int. Cl.[6] ..... A63B 23/16

[52] U.S. Cl. ..... 482/44; 482/47; 482/122; 482/908

[58] Field of Search ..... 601/40; 602/21, 602/62; 2/160, 161.1, 161.2; 128/879; 273/26 C, 188 R, 189 R, 185 A, 452; 473/61, 62; 482/44, 47, 48, 49, 121–124, 905, 908; 373/379.03, 379.05, 379.08

[56] References Cited

U.S. PATENT DOCUMENTS

| | | | |
|---|---|---|---|
| 327,918 | 10/1885 | Brotherhood | 482/48 |
| 440,837 | 11/1890 | Bonelli | 482/48 |
| 911,925 | 2/1909 | Zeno | 482/123 |
| 3,606,316 | 9/1971 | Krewer | 601/40 |
| 3,871,646 | 3/1975 | Slack | 482/48 |
| 3,937,462 | 2/1976 | Kusmer | 482/121 |
| 3,982,757 | 9/1976 | McDonnell | 73/379.08 X |
| 4,822,027 | 4/1989 | Kascak | 482/46 |
| 5,380,259 | 1/1995 | Robertson et al. | 601/40 |

*Primary Examiner*—Richard J. Apley
*Assistant Examiner*—Jeanne Clark
*Attorney, Agent, or Firm*—Thomas W. Secrest

[57] ABSTRACT

The subject matter is a finger exerciser. The finger exerciser comprises a base and an upright support which is movable on the base. On the upright support there is a rotatable pointer. There is a scale to indicate the degree of movement of the pointer. There is a variable tensioning means operatively connecting with the pointer. This variable tensioning means can be rubber bands. There is a hand rest. A person can place the hand on the hand rest and in one version a person can retract the finger so as to move the pointer. In another version, the person can extend the finger so as to move the pointer. The upright support is moveable on the base. This provides a variable distance between the hand rest and rotatable pointer to accommodate hands of different sizes and fingers of different lengths. The force required to move the pointer can be varied by the use of different rubber bands and by the use of a multiplicity of rubber bands to make it more difficult or less difficult to rotate the pointer.

6 Claims, 9 Drawing Sheets

FINGER EXERCISING APPARATUS

THE BACKGROUND OF THE INVENTION

1. Field of the Invention

A person, because of various reasons, may need to exercise one or more fingers.

A finger may be weakened because of an injury or a stroke. Also, a finger may be inherently weak and it may be desirable to increase the strength of the finger.

Another cause of weakening of a finger may be due to placing a cast on a hand. With a cast there is a loss of motion and loss of exercise. With a cast on the hand dupuytrens contractive becomes active and the finger movement and the finger bending is restricted.

An injury may result from numerous causes such as auto accident, working with tools, repairing or building an article or from an athletic endeavor, falling and/or slipping on snow and/or ice.

Also, a finger may not respond strongly because of the aftereffects of a stroke.

An injured finger may be in such a condition that it cannot retract or cannot extend or a combination of not being able to retract and not being able to extend.

A physician or doctor can recommend a finger exercise. The patient may rent a finger exerciser or go to an exercise machine at a suitable place and exercise the finger. If the patient has sufficient means, the patient can buy a finger exerciser.

I hurt a finger and needed to exercise the finger to regain strength in the finger. As a result, I conceived of and developed the subject invention. The finger exerciser that I developed I made from wood and plywood. The finger exerciser I developed can be used so that the finger can retract or so that the finger can extend or do both of these manual exercises.

DESCRIPTION OF THE PRIOR ART

None of these patents teach of a movable lever and a tensioning means to restrict the movement of the lever. The lever can be used for exercising the retracting muscles of a finger. Also, the lever can be used for exercising the extending muscles of the finger.

The subject invention teaches of a scale and a pointer for an indication of strength of the muscle. The above-cited patents are devoid of a scale and a pointer.

Again, the applicant considers that the subject invention defines over all of the above-listed references.

SUMMARY OF THE INVENTION

This invention comprises a lever arm and a tensioning means to restrict the rotation of the lever arm.

A person can exercise a finger by moving the lever arm.

For example, a person can retract a finger by rotating the lever arm. A tensioning means acts against the rotation of the lever arm. As a result with the retraction of the finger, the finger is exercised.

Likewise, a person can extend a finger. With the extension of the finger, the lever arm is rotated. A tensioning means acts against the rotation of the lever arm so as to restrict the rotation of a lever arm. In this manner, the finger is exercised when the finger is extended and rotates the lever arm.

OBJECTS AND ADVANTAGES

There are numerous objects and advantages of this finger exercising machine of which one it is a low cost exercising machine;

Another advantage is that the exerciser is light-weight, relatively small, and is portable;

The exerciser has adjustable features making it possible to accommodate different size hands and fingers;

The exerciser has a variable tensioning means for fingers requiring different retracting strengths and different extending strengths; and, The exerciser has tensioning means which can be readily replaced and readily adjusted to provide variable tensioning.

A further object is the provision of an indicator and a scale for visually showing the daily progress in the exercising of the finger.

THE DRAWINGS

In the drawings it is seen:

FIGS. 1–5 are directed to a finger retracting apparatus wherein FIG. 1 is a side-elevational view showing a base, an upright support, a pivot point on the upright support, a pointer or lever positioned on the pivot point, a scale, a variable tensioning means, an adjustable hand rest and a finger loop on the arm of the pointer for receiving a finger;

FIG. 2 is a perspective view of the apparatus of FIG. 1 and illustrates a finger in the finger loop for rotating the pointer;

FIG. 3 is a top plan view of the apparatus of FIG. 1;

FIG. 4 is a side elevational view illustrating the adjustable position between the pointer and the hand rest;

FIG. 5 is a side elevational view illustrating the hand and finger with the hand on the hand rest and the finger in the finger loop and the pointer moved because of the retraction of the finger;

FIGS. 6–8 are directed to a finger exercising apparatus whereby the finger is extended for strengthening the muscles of the finger and wherein FIG. 6 is a side elevational view illustrating the base, upright support, a pointer lever and a scale, a hand rest, a pressure pad on the pointer and a tensioning means;

FIG. 7 is a top plan view of the apparatus of FIG. 6;

FIG. 8 is a side elevational view illustrating the adjustable feature for varying the distance between the hand rest and the pointer and also with the hand on the hand rest and a finger extended for moving the pointer over the scale for exercising the muscles of the finger;

FIGS. 9–11 are directed to a combined apparatus for a finger retracting exercise and also for finger extending exercise and wherein FIG. 9 is a side elevational view showing the base, the upright support, the hand rest, the pointer or lever with a pressure pad, an associated scale for allowing a finger to be extended for exercising the muscles;

FIG. 10 is a side elevational view of the other side of the exerciser of FIG. 9 and illustrates the hand rest, the pointer or lever and associated scale, and a finger loop for receiving a finger so as to allow the finger to be retracted and to exercise the retraction power of the finger;

FIG. 11 is a top plan view looking down on the apparatus of FIGS. 9 and 10 and showing the upright support and the pointer or lever for the finger to be extended and also the pointer for the finger to be retracted;

Figure 13:
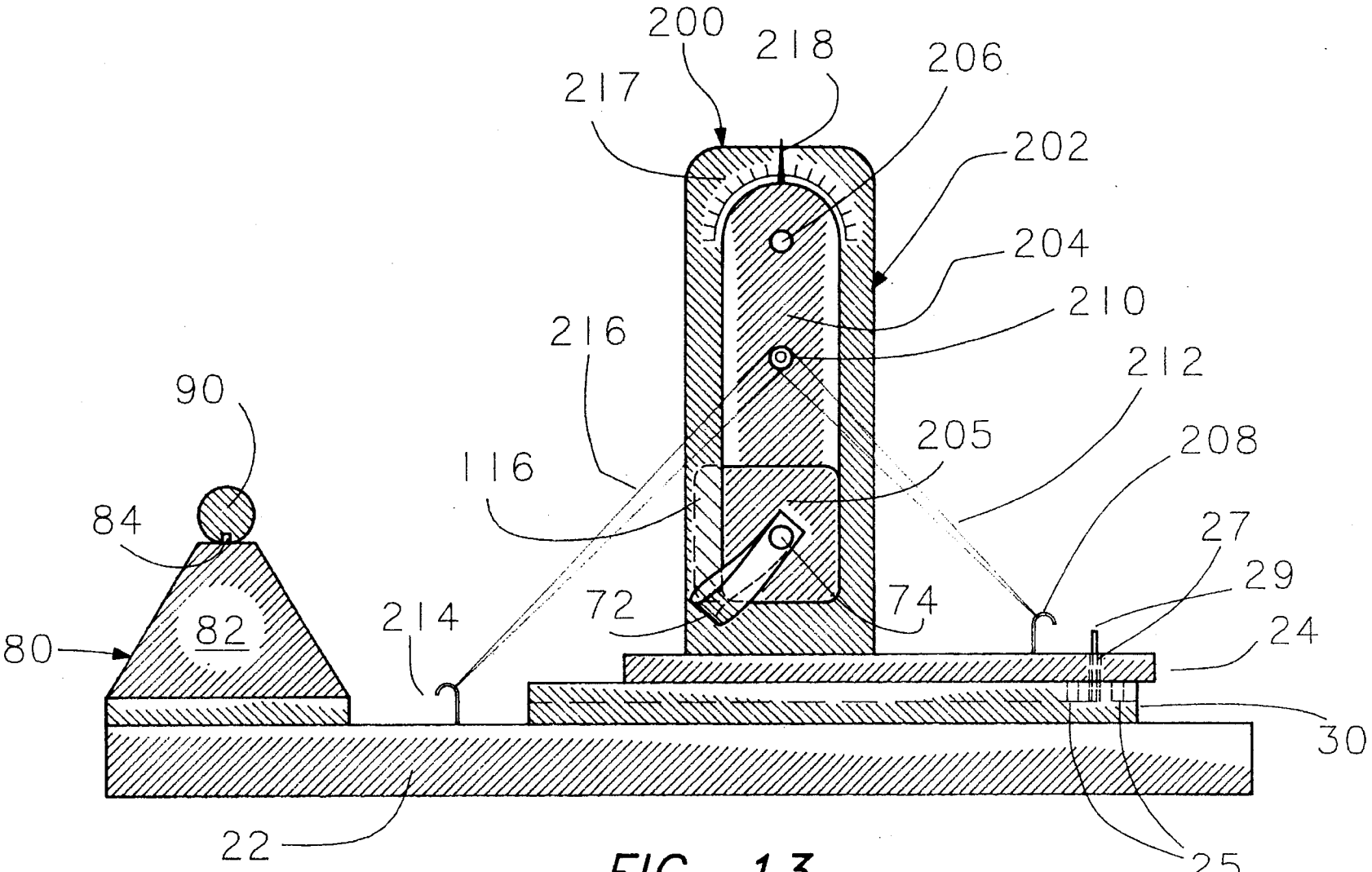
Figure 15:
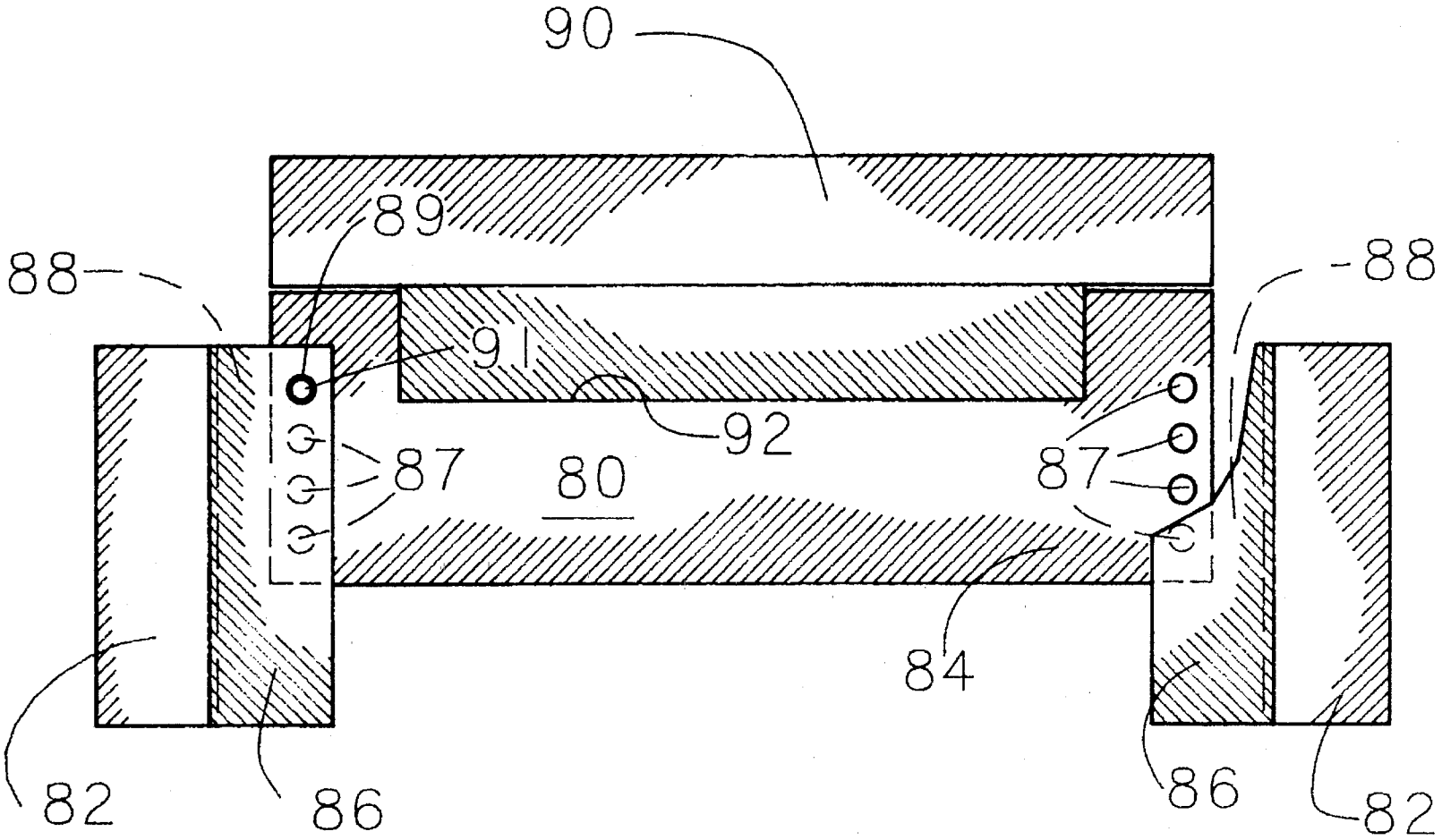
Figure 14:
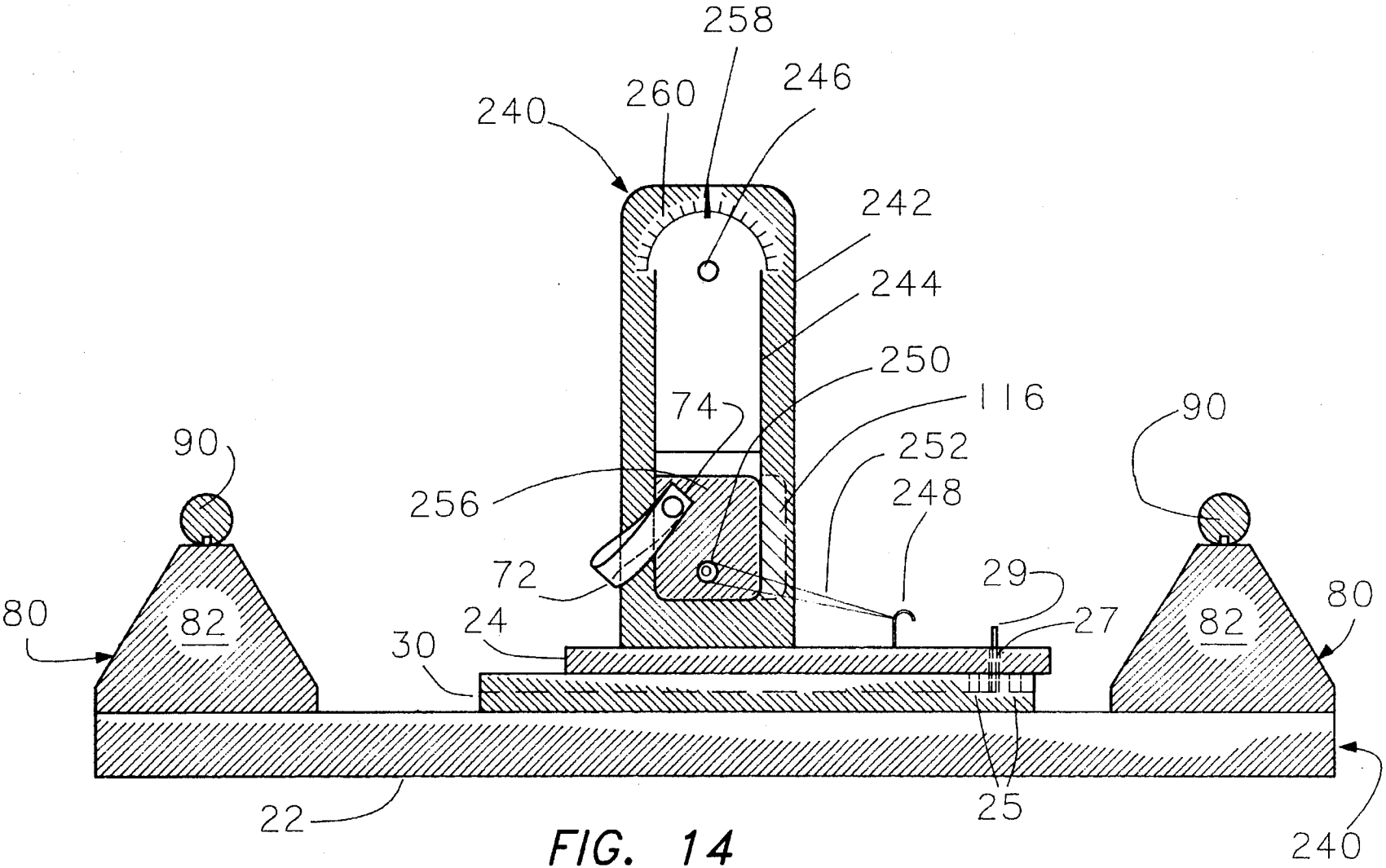

FIG. 13 is a side elevational view of a finger exerciser showing a base, a movable platform and a guide rail for the base, an upright pedestal and movable arm with two tensioning means of which one tensioning means is for exercising the extender muscles in a finger and the tensioning means is for exercising the retracting muscles in a finger; and a scale and a pointer for indicating the strength of a muscle;

FIG. 14 is a side elevational view of another exerciser comprising a base, a movable platform, a guide rail for the movable platform, and upright pedestal, a movable arm on the pedestal and one tensioning means which can be used for exercising the retracting muscles in a finger and also can be used for exercising the extending muscles in a finger; and, FIG. 15 is a front elevational view of the adjustable hand rest and illustrates the side supports and the vertically moveable hand rest.

DESCRIPTION OF THE PREFERRED EMBODIMENT

With respect to FIGS. 1–5, there is illustrated a finger retracting exerciser 20 having a base 22;

There is a movable platform 24 comprising a lower member 26 and an upper member 28. These members are of generally rectangular construction with the lower member 26 being wider than the upper member 28.

There are two spaced-apart guide rails 30 having an inwardly projecting lip 32 on the upper part and which lip overlies the lower member 26. The guide rail 30 restricts the movement of the movable platform 24 to a rectilinear movement.

In the platform 24 are a number of recesses 25. In the guide rail 30 is a recess 27, FIG. 3. A pin 29 can be positioned in the recess 27 and an appropriate recess 25 to restrict movement of the moveable platform 24.

In the upper member 28 there is a longitudinal recess 34.

There is positioned in the longitudinal recess 34 an upright support 36.

The support 36 has a lower straight edge 38; an outer upright straight edge 40; an upper edge 42; a curved edge 44 joining edges 40 and 42; an inner edge 46; a curved edge 48 joining upper edge 42 and inner edge 46; and a reverse curved edge 50 joining inner edge 46 and a lower straight edge 38.

There is a rotatable pointer 52 having a base area 54. The pointer 52 comprises a pointer arm 56 and lower arm 58. There is a pivot pin or pivot point 60 attaching the rotatable pointer 52 to the upright support 36. The rotatable pointer 52 can rotate around the pivot pin 60 or pivot point 60.

Also, there is a scale 62. On the upper part of the scale 62, with respect to FIG. 2, there is a pointer stop 64, to limit the counter-clockwise rotation of the pointer arm 56 and away from the pointer stop 64. The scale 62 makes it possible to gauge the increase or decrease in the strength of the finger muscles with exercise.

On the lower part of the lower arm 58, there is an attaching means 66 such as a hook.

It is seen that on the lower part of the upright support 36, there are three spaced-apart attaching means or hooks 68.

A flexible backload elastic tension means 70 can be used to connect the hook 66 with one of the hooks 68. In the exerciser that I constructed, I used rubber bands as the flexible backload elastic tension means. There are various grades of rubber bands. Depending upon the strength of the finger muscles, various grades of rubber bands can be used. In fact, two or three rubber bands may be used to connect with the hook 66 and also with one of the hooks 68.

It is seen that on the lower part of the lower arm 58 that there is a finger loop 72 attached by means of a pin or other suitable attaching means 74 to the rotatable pointer 52.

There is an adjustable hand rest 80 comprising two spaced-apart trapezoidal supports 82. There is a central upright member 84 positioned between the supports 82. There are two end members 86 positioned between the central upright member 84 and trapezoidal supports 82. At each end member 86 there is a guide recess 88.

Reference is now made to FIG. 15.

The upright member 84 is positioned in each guide recess 88 and is vertically moveable in the guide recesses 88. In the upper part of each end member 86 there is a recess 89. Along the vertical sides of 84 there are a number of recesses 87. The member 84 can be moved to an appropriate height and a pin 91 can be positioned in the recess 89 and in an appropriate recess 87 to vertically position the hand rest 80.

In the upper part of the member 84 there is a central recess 92. On top of member 84 and bridging the recess 92 is a cylindrical rest 90 for receiving a person's hand.

Figure 2:
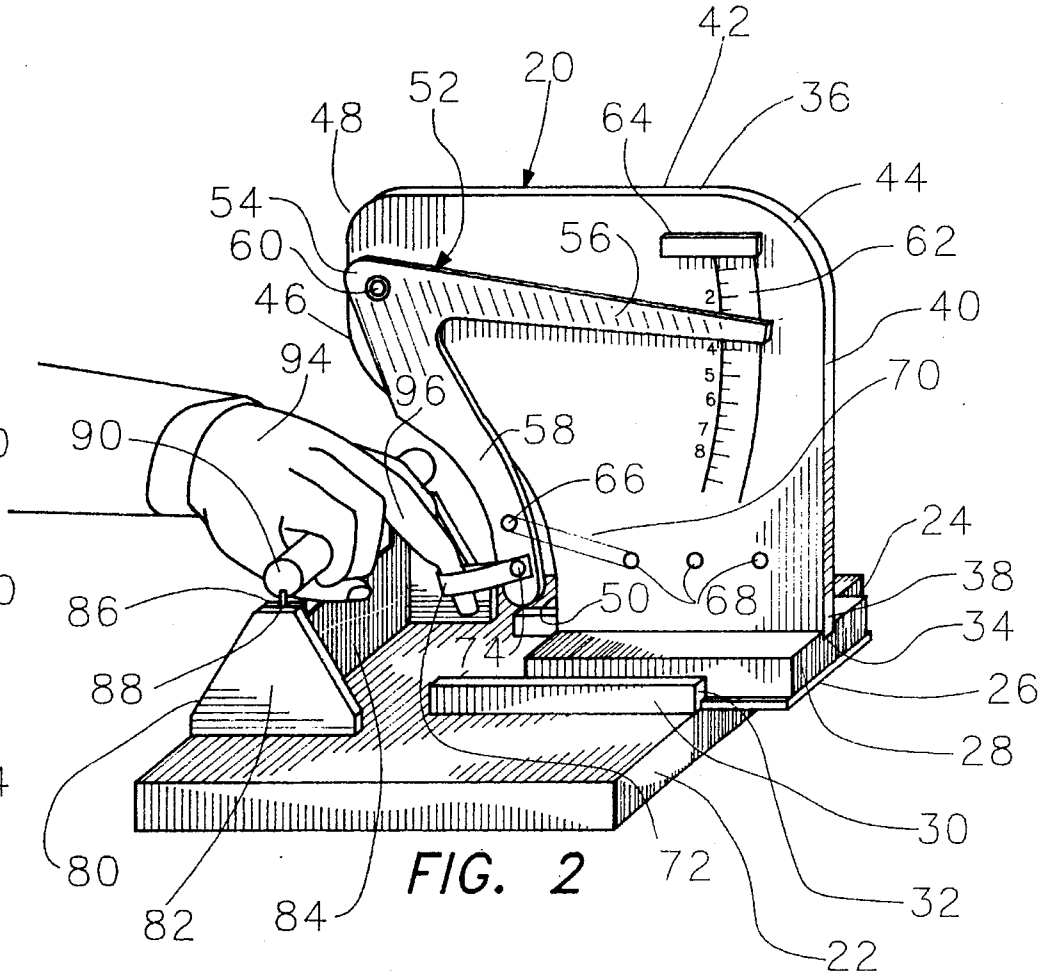
Figure 1:
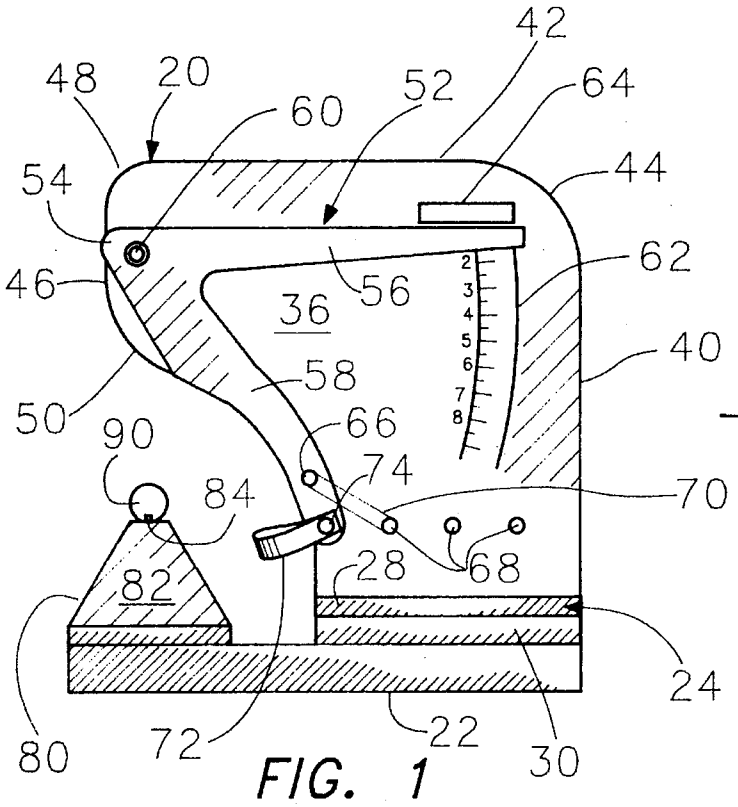
Figure 4:
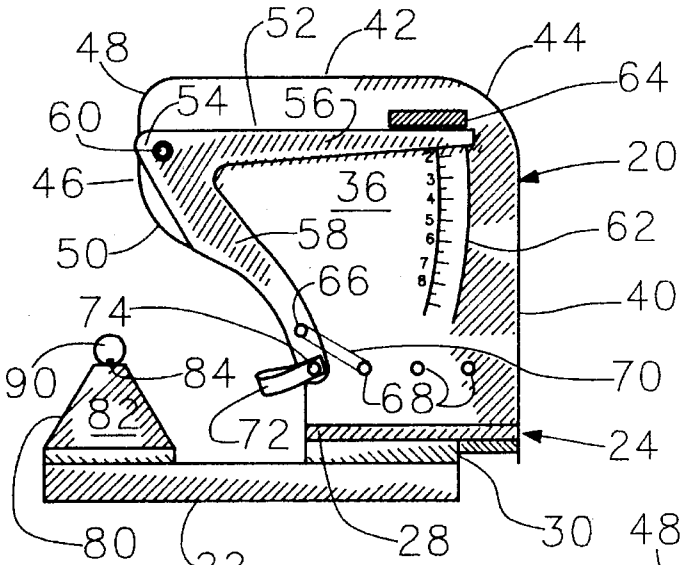
Figure 5:
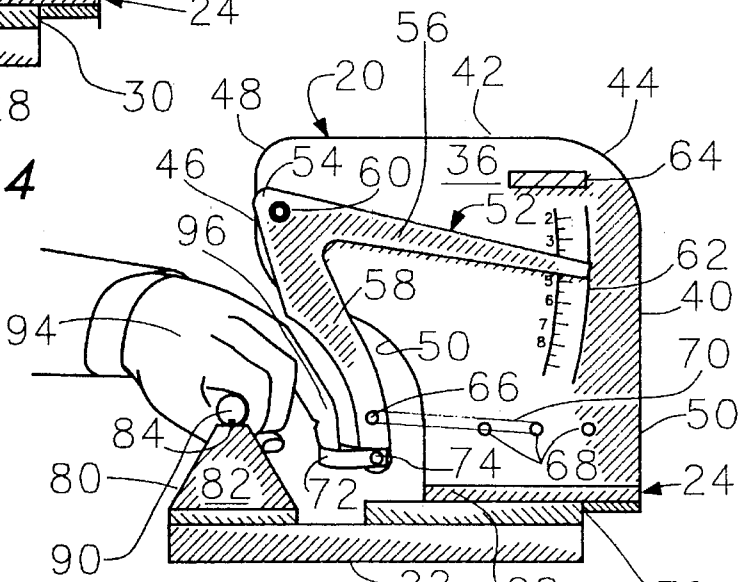
Figure 3:
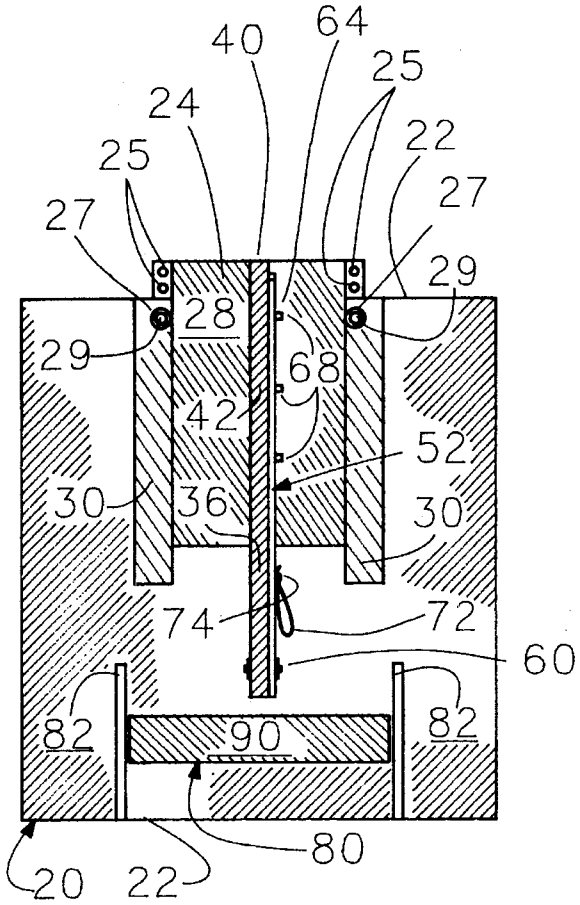
Figure 8:
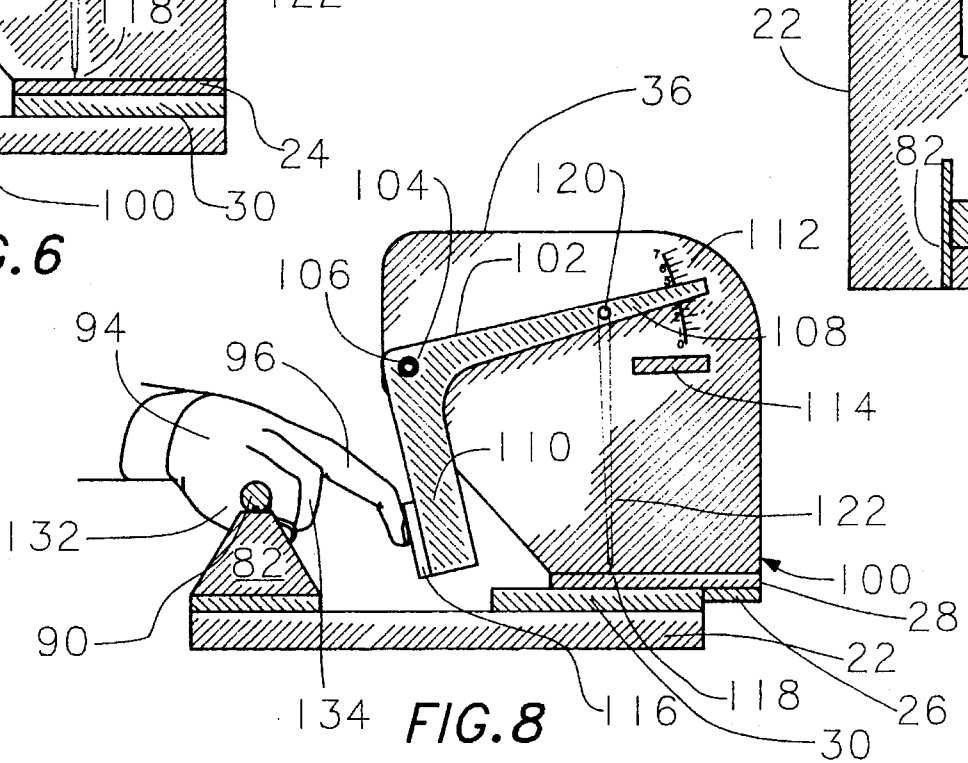

A person's hand 94, see FIGS. 2, 5 and 8, may be positioned on the cylindrical rest 90 or may have the fingers encircling the hand rest 90.

A finger 96 of the hand 94 may be positioned in the finger loop 72 for rotating the pointer arm 56, see FIGS. 2 and 5, in a clock-wise direction.

The FIGS. 1, 2, 4 and 5 illustrate that the movable platform 24 can be moved and thereby the position of the upright support 36 can be varied with respect to the hand rest 90. This makes it possible for hands of different sizes and fingers of different lengths to be accommodated by the finger retracting exerciser 20. The guide rail 30 restricts the movement of the moveable platform 24 and the upright support 36 to a rectilinear movement toward and away from the hand rest 90.

Also, in the drawings it is seen that the rubber band tensioning means 70 can be adjusted to accommodate the retracting strength of the finger undergoing exercise. For a weak finger 96, a small rubber band can be used. For a stronger finger 96, a bigger rubber band and a multiplicity rubber band can be used.

Figure 7:
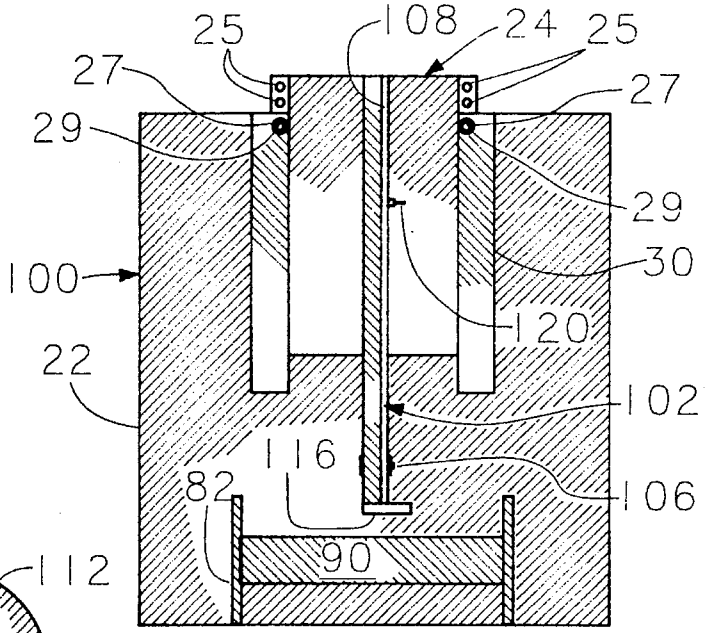
Figure 6:
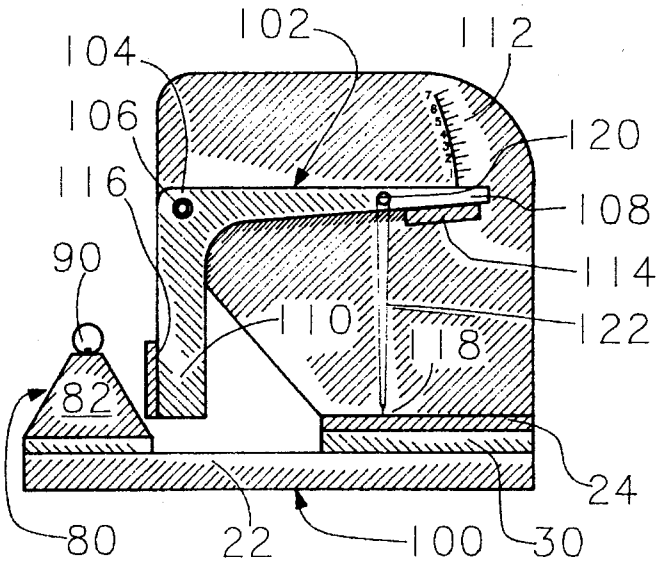

In FIGS. 6, 7 and 8, there is illustrated a finger extender exerciser 100.

The base 22, the movable platform 24, lower member 26, upper member 28, guide rail 30, inwardly projecting lips 32 and recess 34 and their upper member 28 and hand rest 80 are the same in the exerciser 100 as in the exerciser 20 and therefore will be adopted at this place without further discussion.

Also, the upright support 36 of the retracting exerciser 20 is similar to the upright support of the exerciser 100 and will be adopted at this place without further discussion.

There is a rotatable pointer 102 having a base area 104. There is a pivot pin or pivot point 106 attaching the base of the base area 104 to the upright support 36. The pointer 102 comprises a pointer arm 108 and a lower arm 110. The pointer arm 108 and the lower arm 110 are substantially at right angles to each other.

With respect to FIGS. 6 and 8, there is a scale 112 on the upper right area of the upright support 36. The scale 112 makes it possible to gauge the increase or decrease in the strength of the finger muscles with exercise.

Below the scale there is a pointer stop 114, with respect to FIGS. 6 and 8, to restrict the clock-wise rotation of the pointer arm 108.

On the outside of the lower part of the lower arm 110, there is a pressure pad 116.

On the lower surface of the upper member 28, there is an attaching means 118. The attaching means 118 may be a hook. On the outer part of the pointer arm 108, there is an attaching means 120. The attaching means 120 may be a hook. There is a backload elastic tension device 122 stretching between the hook 118 on the upper member 28 and the hook 120 on the pointer arm 108. The tensioning means 122 may be a rubber band or a plurality of rubber bands.

There is a hand rest 80 and which was described with reference to FIGS. 1–5 and which description is adopted at this time.

A person can place a hand 94 on top of the cylindrical rest 90. A thumb 132 with respect to FIG. 8, is on the outside of the upright member 84. An index finger 96 can extend over the top of the rest 90 and be on the inside of the member 84. The injured finger 96 can be extended to bear against the pressure pad 116 to rotate the pointer arm 108 in a counter-clockwise direction, with respect to FIGS. 6 and 8, over the scale 112 and away from the pointer stop 114.

Again, the tension on the backload elastic tension device 122 can be adjusted by the use of a rubber band or rubber bands and various sizes of rubber bands.

In FIGS. 6 and 8, it is seen that there is a different position for the moveable platform. This makes it possible to adjust the exerciser 100 for receiving the hands of different sizes and fingers of different lengths. There are recesses 25 in the movable platform 24, see FIG. 7. There is a recess 27 in the guide rail 30. There is a pin 29 for positioning in the recess 27 and the appropriate recess 25. This positions the movable platform 24.

Figure 10:
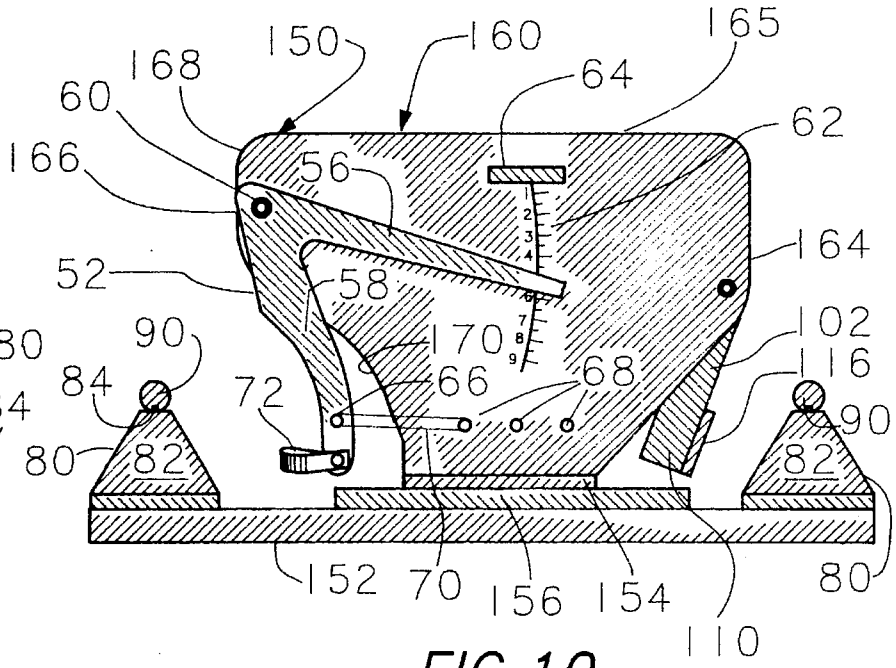
Figure 9:
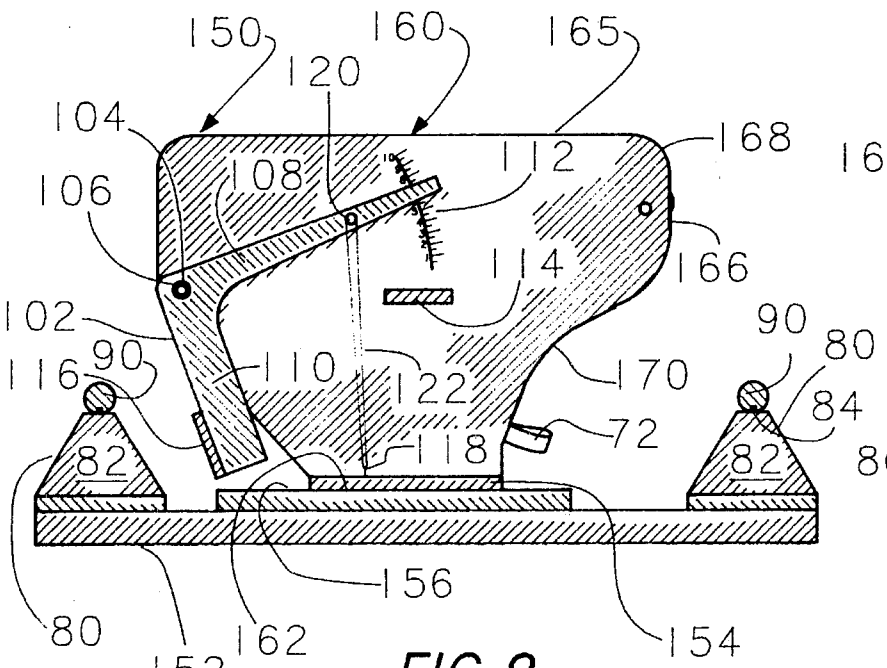
Figure 11:
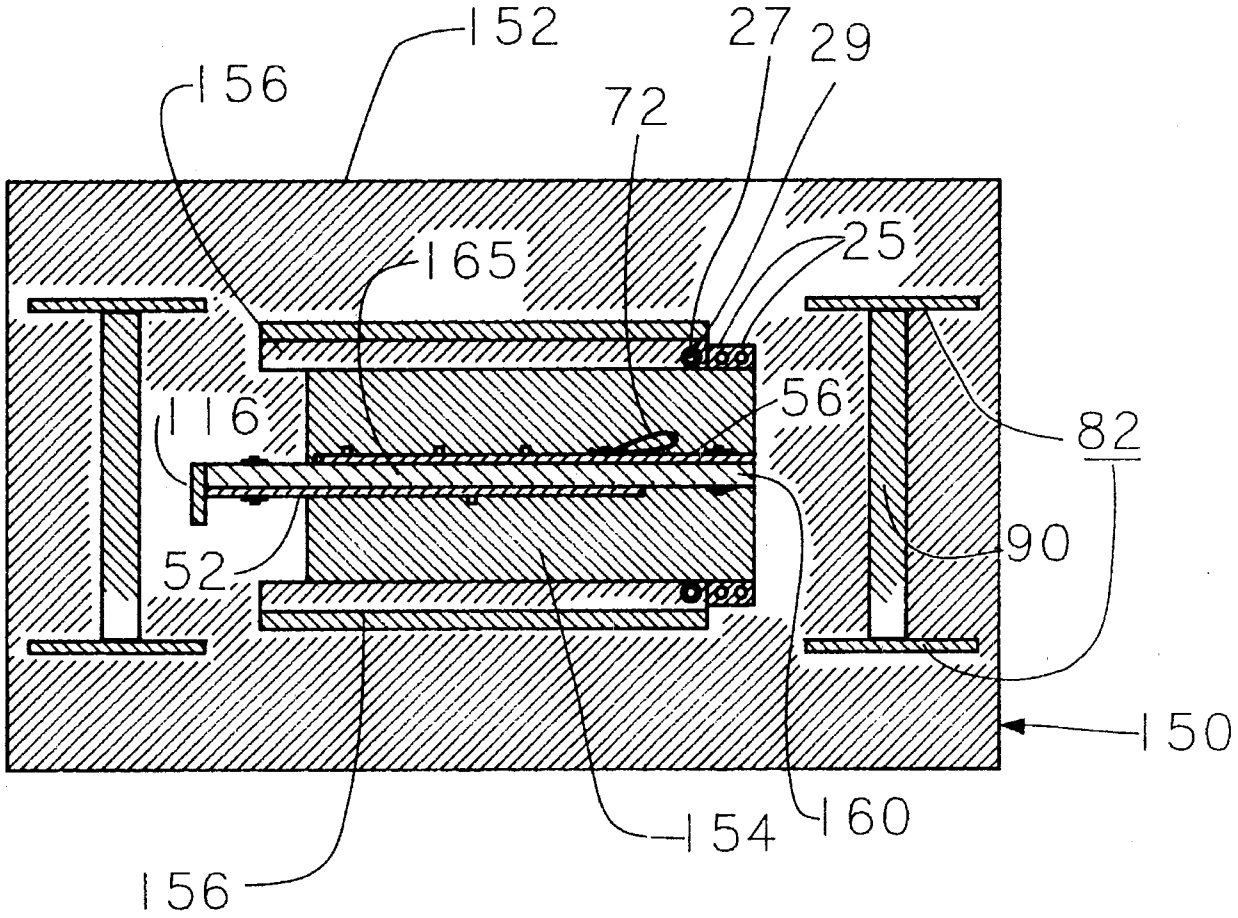

In FIGS. 9 through 11 there is illustrated a combined finger retractor and finger extender exerciser 150.

150 comprises a base 152 of rectangular configuration.

On the base there is a moveable platform 154. There are two spaced-apart guide rails 156 operatively connecting with the moveable platform 154 to restrict the motion of the platform 154 to a rectilinear motion or movement.

In the platform 154 are recesses 25. In the guide rail 156 is a recess 27. A pin 29 can be positioned the recess 27 and an appropriate recess 25 to firmly position the platform 154.

There is an upright support 160 on the moveable platform 154. The support 160 comprises a lower straight edge 162 in contact with the platform 154. Then, there is an upright curved edge 164 which meets with a horizontal upper edge 165. There is an upright straight edge 166. A curved edge 168 joins 165 and 166. Then, there is reverse curve 170 joining the edge 166 and the lower straight edge 162.

The pointer arm 108 and the adjustable hand rest and the rest of the elements of the finger extender exerciser 100 are used or adopted in exerciser 150. The pointer arm 108, scale 112 and adjustable hand rest 80 are illustrated in FIG. 9.

The retracting exerciser elements of the exerciser 20 are illustrated in FIG. 10 and are adopted at this place without further discussion. There is a pointer arm 56, a scale 62, an adjustable hand rest 80 and a finger loop 72.

The finger retracting exerciser 20 as illustrated in FIGS. 1 through 5 is also illustrated in FIGS. 10 and 11. The same elements and components of FIGS. 1 through 5 are used in FIGS. 10 and 11.

The finger exerciser elements of finger extender exerciser 100 as illustrated in FIGS. 6, 7 and 8 are also illustrated in FIGS. 9 and 11.

A specific description of the retracting finger exerciser and a specific description of the extender finger exerciser are not required for FIGS. 9 through 10, as they have been described in detail in the foregoing parts of this textual material.

Figure 12:
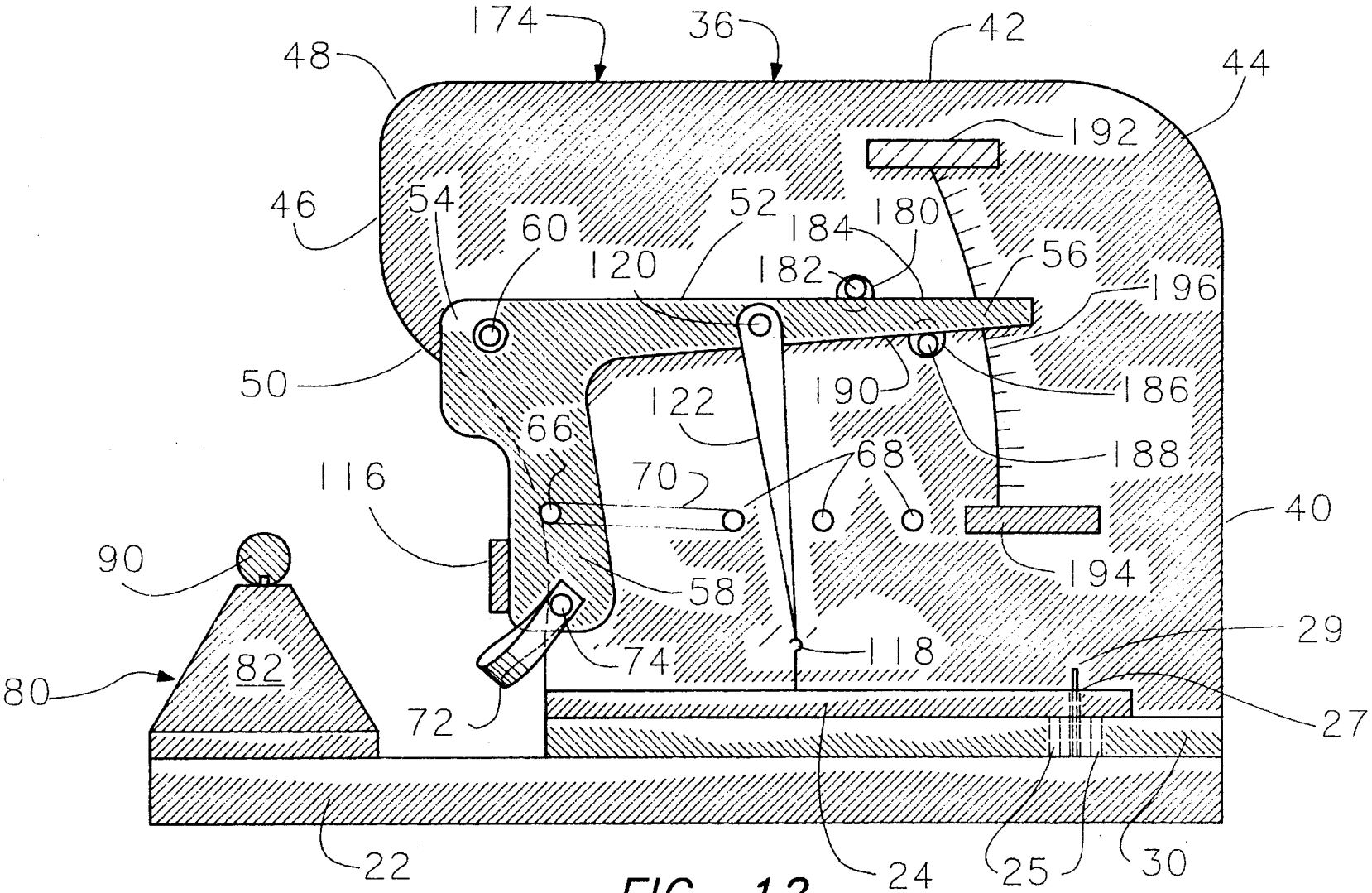
FIG. 12 is a side elevational view of a finger exerciser comprising a base, an upright support, a pivot point on the support, a pointer or lever positioned on the pivot point, a scale, a variable tensioning means, and a means for a finger to retract and to rotate the pointer and means for a finger to extend and to rotate the pointer.

In FIG. 12 there is illustrated a finger exerciser 174.

Exerciser 174 comprises many of the components and elements of the previously described finger exercisers. For example, there is a base 22. On the base 22 is a movable platform 24. There are guide rails 30 for restricting the movement of the platform 24 to a rectilinear movement toward and away from the hand rest 80.

In the guide rail 30 there is a recess 27. In the platform 24 there are recesses 25. A pin 29 can be positioned in the recess 27 and an appropriate recess 25 to firmly position the platform 24.

On the movable platform 24, there is an upright support 36. On the right of the upright support 36, there is an upright or vertical edge 40. On the upper part of 36 there is a horizontal edge 42. There is a curved edge 44 uniting 40 and 42.

On the left of the support 36, there is an edge 46. A curved edge 48 unites the horizontal edge 42 and the edge 46. There is reverse curve edge 50 joining with edge 46 in the lower part of the upright support 36.

There is a rotatable pointer 52 having a base portion 54. The pointer 52 has an upper arm 56 and a lower arm 58.

There is a pivot point or pin 60 connecting the base 54 to the upright platform 36. The rotatable pointer 52 can rotate around the pivot pin or point 60.

On the lower part of the lower arm 58, there is a hook or attaching means 66. On the lower central part of the upright support 36, there is a series of hooks 68. A rubber band 70 can connect the hook 66 with one or more of the hooks 68 so as to vary the tension or backload on the downward rotation of the upper arm 56 or the finger retraction of a hand pulling on the pointer 52 to rotate the pointer 52 in a clock-wise direction with respect to FIG. 12.

There is a loop 72 attached by a pin or attaching means 74 to the lower part of the arm 58.

There is a hand rest 80 having a cylindrical rest 90. A person can rest a hand on the cylindrical rest 90 and place a finger in the loop 72. Then the person can retract the finger to exercise the finger. The hand rest 80 has been described in detail with respect to FIG. 15, and the description will not be repeated here.

On the outside of the lower arm 58 and towards the hand rest 80, there is a pressure extender pad 116.

On the movable platform 24 there is a hook or attaching means 118.

On the upper arm 56 there is a hook or attaching means 120. A rubber band or tensioning means 122 connects hooks 118 and 120. When the finger is extended and the upper arm 56 rotates in a counter-clockwise direction, the rubber band or tensioning means works against the rotation of the upper arm 56 in a counter-clockwise direction.

It is seen that in the upright support 36 there is an upper hole 180, above the upper arm 56. In the upper hole 180 there is an upper peg 182 to restrict the counter-clockwise movement of the upper arm 56. The upper arm 56 has an upper edge 184 which can bear against the upper peg 182.

There is a lower hole 186. The lower hole 186 is below the upper arm 56. In the lower hole 186, there is a lower peg 188. The upper arm 56 has a lower edge 190 which can bear against the lower peg 188.

There is a scale 196. On the upper edge of the scale 196 there is an upper stop 192. On the lower end of the scale 196 there is a lower stop 194. Assume that a person wishes to retract the finger and exercise the retractive muscles of the finger. The lower peg 188 can be removed from the lower hole 186. Then the person can place the hand on the hand rest 80 and the loop 72. The person can retract the finger so as to rotate the upper arm 56 in a clock-wise direction and also to exercise the retractive muscles of the finger.

Assume that the person wishes to extend the finger and exercise the extending muscles of the finger. The person can remove the upper peg 182 from the upper hole 180. The person can place the hand on the hand rest 80 and the finger against the pressure extender pad 116 and extend the finger. The rubber band or tensioning means 122 act against the rotation of the upper arm 56 in a counter-clockwise direction and make it necessary to exercise the extender muscles of the finger.

The reader can readily understand that a rubber band can be removed for a finger exerciser. For extending, the rubber band 70 can be removed. For retracting the finger, the rubber band 122 can be removed.

The scale 196 give an indication of the degree of rotation of the upper arm 56. The upper stop 192 limits the counter-clockwise rotation of the upper arm 56. The lower stop 194 limits the clockwise rotation of the upper arm 56.

A person can observe the movement of the upper arm 56 with respect to the scale 196 and gauge the increase or decrease in the strength of the finger with exercise.

The finger exerciser 174 combines in one unit and in one rotatable pointer 52 both a finger retraction exerciser and a finger extender exerciser.

In FIG. 13 it is seen that a finger exerciser 200 comprising a base 22, a movable platform 24 and a guide rail 30. The guide rail 30 restricts the movement of the movable platform 24 to a rectilinear movement on the base 22.

In the platform 24 are a plurality of recesses 25. In the guide rail 30 there is a recess 27. A pin 29 can be positioned in the recess 27 and an appropriate recess 25 to firmly position the platform 24.

On the movable platform 24 there is an upright pedestal 202. There is positioned a movable arm 204 on the upright pedestal 202 by means of a pivot pin or pivot point 206. The movable arm 204 can rotate around the pin 206.

On the movable platform 24, there is a hook 208 or attaching means 208. Also, on the movable arm 204 there is an attaching means 210. A tensioning means 212 connects the hook 208 and the attaching means 210. The tensioning means could be a rubber band or a plurality of rubber bands.

On the base 22, there is a hook 214. A tensioning means 216 connects with the hook 214 and with the attaching means 210. Again, the tensioning means 216 can be a rubber band or a plurality of rubber bands.

It is seen that on the left side of the movable arm 204 and near the lower end that there is an extender pad 116. Also, on the lower end of the movable arm 204 there is a pin 74 for attaching a loop 72 to the movable arm 204. The lower end of the arm 204 can be of increased thickness 205 to accommodate extender pad 116.

There is a hand rest 80 comprising a hand cylindrical rest 90. The hand rest 80 has been described in detail with respect to FIG. 15.

The guide rail 30 guides the rectilinear movement of the movable platform 24 with respect to the hand rest 80 and the hand support 90.

A person wanting to exercise a finger or fingers can place the hand on the cylindrical rest 90 and a finger in the loop 72 and retract the finger so as to rotate the movable arm 204 in a clockwise direction and toward the hand rest 80. In this manner, the retracting muscles on the finger can be exercised.

The reader can readily understand that a rubber band can be removed for a finger exerciser. For extending the finger, the rubber band 212 can be removed. For retracting the finger, the rubber band 216 can be removed.

Also, a person can place the hand on the hand support 90 and place a finger against the extender pad 116. The person can extend the finger and rotate the movable arm 204 in a counter-clockwise direction. The tensioning means 216 restricts the counter-clockwise movement of the movable arm 204 and also makes it necessary for the person to exercise the extender muscles or extending muscles in the finger.

On the upper end of the upright pedestal 202 there is a scale 217. On the upper end of the arm 204 there is a pointer 218. The pointer and the scale give an indication of the change in the strength of the finger muscle.

In FIG. 14, there is illustrated a finger exerciser 240 comprising a base 22.

On the base 22, there are guide rails 30 for guiding the movement of the movable platform 24. The movement of the movable platform 24 is restricted to a rectilinear movement either towards the left end of the base 22 or towards the right end of the base 22. In the platform 24 are a plurality of recesses 25. In the guide rail 30 there is a recess 27. A pin 29 can be positioned in the recess 27 and an appropriate recess 25 to firmly position the platform 24.

There is positioned on the upright pedestal 242 a movable arm 244. A pin 246 or pivot point connects the movable arm 244 to the upper end of the upright pedestal 242.

On the lower end of the movable arm 244, there is an attaching means 250.

On the movable platform and to the right of the pedestal 242 there is a hook 248.

A tensioning means connects the hook 248 with the attaching means 250. The tensioning means 252 can be a rubber band or a series of rubber bands.

On the right side and lower part of the movable arm 244 there is an extender pad 116.

Also, on the lower part of the movable arm 244 there is a loop 72 which attached by means of a pin 74 to the arm 244. The loop 72 extends outwardly to the left of the movable arm 244.

Near the left end of the base 22 and near the right end of the base 22, there is a hand rest 80. The hand rest 80 has been described previously with respect to FIG. 15.

A person can place a hand on the hand rest 80 near the left end of the base 22 and place a finger in the loop 72. A person then can rotate the movable arm 244 in a clock-wise direction and toward the left end of the base 22. This exercises the retracting muscles in a finger.

The lower end of the moveable arm 244 can be of increased thickness at 256 to accommodate the extender pad 116.

Also, a person can place a hand on the hand support 80 near the right end of the base 22 and place the finger against the extender pad 116. A person can extend the finger and rotate the movable arm 244 in a clock-wise direction and away from the right end of the base 22.

In this manner, the person can exercise the extender muscles in the finger.

It is seen that in FIG. 14 there is provided a finger exerciser 240 of a very simple construction, and yet which makes it possible for a person to place a finger in the loop 72 and retract the finger against the force of the tensioning means 252 so as to exercise the retracting muscles of a finger.

Also, it is seen that in the finger exerciser 240 that a person can place a finger against the extender pad 116 and extend the finger to rotate the movable arm 244 in clockwise direction and against the force of the tensioning means 252.

On the upper end of the arm 244 there is a pointer 258. On the upper end of the upright pedestal 242 there is a scale 260. The pointer 258 and the scale 260 give an indication of the strength of the finger muscle. A person can determine the increased or decreased strength of the finger muscle.

In this manner, a person has exercised the extender muscles in a finger.

A finger exerciser comprising a moveable member; a first finger contact means on said moveable member; and, a first tensioning means operatively connecting with said moveable member.

A finger exerciser comprising a moveable member; a first finger contact means on said moveable member; and, a first tensioning means operatively connecting with said moveable member; an upright support; a connecting means operatively connecting said moveable member to said upright support; said moveable member being capable of rotating on said connecting means; a base; a platform mounted on said base; said upright support being mounted on said platform; a hand rest mounted on said base; a guide mounted on said base and operatively connecting with said platform to allow movement of said platform and said upright support with respect to said hand rest; said moveable member comprising a first arm and a second arm; said first finger contact means being on said first arm; a scale on said upright support; and, said second arm juxtapositioned to said scale.

A finger exerciser comprising a moveable member; a first finger contact means on said moveable member; and, a first tensioning means operatively connecting with said moveable member; and upright support; a connecting means operatively connecting said moveable member to said upright support; said moveable member being capable of rotating on said connecting means; a base; a platform mounted on said base; said upright support being mounted on said platform; a hand rest mounted on said base; a guide mounted on said base and operatively connecting with said platform to allow movement of said platform and said upright support with respect to said hand rest; said moveable member comprising a first arm and a second arm; said first finger contact means being on said first arm; a scale on said upright support; said second arm juxtapositioned to said scale; said moveable member comprising a first arm and a second arm; said first finger contact means being on said first arm; a scale on said upright support; said second arm juxtapositioned to said scale; said hand rest having a hand support for receiving a hand and a finger; said hand support being of a size to allow a finger to partially wrap around said hand support; and, said finger contact means being of a configuration to permit a finger to rotate said first arm toward the hand having said finger.

A finger exerciser comprising a moveable member; a first finger contact means on said moveable member; a first tensioning means operatively connecting with said moveable member; and upright support; a connecting means operatively connecting said moveable member to said upright support; said moveable member being capable of rotating on said connecting means; a base; a platform mounted on said base; said upright support being mounted on said platform; a hand rest mounted on said base; a guide mounted on said base and operatively connecting with said platform to allow movement of said platform and said upright support with respect to said hand rest; said moveable member comprising a first arm and a second arm; said first finger contact means being on said first arm; a scale on said upright support; said second arm juxtapositioned to said scale; said moveable member comprising a first arm and a second arm; said first finger contact means being on said first arm; a scale on said upright support; said second arm juxtapositioned to said scale; said hand rest having a hand support for receiving a hand and a finger; said hand support being of a size to allow a finger to partially wrap around said hand support; and, said finger contact means being of a configuration to permit a finger to rotate said first arm away from the hand having said finger.

A finger exerciser comprising a moveable member; a first finger contact means on said moveable member; a first tensioning means operatively connecting with said moveable member; an upright support having a first side and a second side; a connecting means operatively connecting said moveable member to said upright support on said first side; said moveable member being capable of rotating on said connecting means; said moveable member being identified as a first moveable member; said first moveable member comprising a first arm and a second arm; said first finger contact means being on said first arm; a second moveable member having a third arm and a fourth arm; a second connecting means operatively connecting said second moveable member to said upright support on said second side; said second moveable member being capable of rotating on said second connecting means; a second finger contact means being on said third arm; and, a second tensioning means operatively connecting with said second moveable member.

A finger exerciser comprising a moveable member; a first finger contact means on said moveable member; a first tensioning means operatively connecting with said moveable member; said first finger contact means being capable of receiving a finger for moving said moveable member towards the hand on which the finger is attached; said tensioning means resisting the movement of said finger toward said hand; said finger contact means being capable of receiving a finger for moving said moveable member away from the hand on which the finger is attached; and, said tensioning means resisting the movement of said finger away from said hand.

A process for making a finger exerciser and comprising forming a moveable member with a finger contact means; and, operatively connecting a first tensioning means with said member to resist movement of said moveable member.

A process for making a finger exerciser and comprising forming a moveable member with a finger contact means; and, operatively connecting a first tensioning means with said member to resist movement of said moveable member; forming said finger contact means to be capable of receiving a finger for moving said moveable member towards the hand on which the finger is attached; and, forming said finger contact means to be capable of receiving a finger for moving said moveable member away from the hand on which the finger is attached.

A process for making a finger exerciser and comprising forming a moveable member with a finger contact means; and, operatively connecting a first tensioning means with said member to resist movement of said moveable member; forming an upright support; and, operatively connecting said moveable member to said upright support.

A process for making a finger exerciser and comprising forming a moveable member with a finger contact means; and, operatively connecting a first tensioning means with said member to resist movement of said moveable member; forming a base; mounting a platform on said base; and, mounting said upright support on said platform.

A process for making a finger exerciser and comprising forming a moveable member with a finger contact means; and, operatively connecting a first tensioning means with said member to resist movement of said moveable member; mounting a hand rest on said base; mounting a guide on said base and operatively connecting said guide and said platform to allow movement of said platform and said upright support with respect to said hand rest; forming said first moveable member to have a first arm and a second arm; positioning a finger contact means on said arm; forming said finger contact means to be capable of receiving a finger for moving said moveable member towards the hand on which the finger is attached; forming a scale on said upright support; juxtapositioning said second arm to said scale; forming a second moveable member with a finger contact means; operatively connecting a tensioning means with said second moveable member to resist movement of said second moveable member; forming said second moveable member to have a third arm and a fourth arm; forming said finger contact on said second moveable member to be capable of receiving a finger for moving said second moveable member away from the hand on which the finger is attached; forming a second scale on the second surface of said upright support; and, mounting said second moveable member on said second surface and juxtapositioning said fourth arm to said scale.

A finger exerciser made by a process comprising forming a moveable member with a finger contact means; and, operatively connecting a first tensioning means with said member to resist movement of said moveable member.

A finger exerciser made by a process comprising forming a moveable member with a finger contact means; operatively connecting a first tensioning means with said member to resist movement of said moveable member; forming said finger contact means to be capable of receiving a finger for moving said moveable member towards the hand on which the finger is attached; and, forming said finger contact means to be capable of receiving a finger for moving said moveable member away from the hand on which the finger is attached.

A finger exerciser made by a process comprising forming a moveable member with a finger contact means; operatively connecting a first tensioning means with said member to resist movement of said moveable member; forming an upright support; and, operatively connecting said moveable member to said upright support.

A finger exerciser made by a process comprising forming a moveable member with a finger contact means; operatively connecting a first tensioning means with said member to resist movement of said moveable member; forming a base; mounting a platform on said base; and, mounting said upright support on said platform.

A finger exerciser made by a process comprising forming a moveable member with a finger contact means; operatively connecting a first tensioning means with said member to resist movement of said moveable member; mounting a hand rest on said base; mounting a guide on said base and operatively connecting said guide and said platform to allow movement of said platform and said upright support with respect to said hand rest; identifying said moveable member as a first moveable member; forming said first moveable member to have a first arm and a second arm; positioning a finger contact means on said arm; forming said finger contact means to be capable of receiving a finger for moving said moveable member towards the hand on which the finger is attached; forming said finger contact means to be capable of receiving a finger for moving said moveable member away from the hand on which the finger is attached; forming a scale on said upright support; juxtapositioning said second arm to said scale; said upright support having a first surface and a second surface; and, mounting said first moveable member and said scale on said first surface.

A finger exerciser made by a process comprising forming a moveable member with a finger contact means; operatively connecting a first tensioning means with said member to resist movement of said moveable member; mounting a hand rest on said base; mounting a guide on said base and operatively connecting said guide and said platform to allow movement of said platform and said upright support with respect to said hand rest; forming said first moveable member to have a first arm and a second arm; positioning a finger contact means on said arm; forming said finger contact means to be capable of receiving a finger for moving said moveable member towards the hand on which the finger is attached; forming a scale on said upright support; juxtapositioning said second arm to said scale; forming a second moveable member with a finger contact means; operatively connecting a tensioning means with said second moveable member to resist movement of said second moveable member; forming said second moveable member to have a third arm and a fourth arm; forming said finger contact on said second moveable member to be capable of receiving a finger for moving said second moveable member away form the hand on which the finger is attached; forming a second scale on the second surface of said upright support; and, mounting said second moveable member on said second surface and juxtapositioning said fourth arm to said scale.

What I claim is:

1. A finger exerciser comprising:

a. a first moveable member;

b. a first finger contact means on said first moveable member;

c. a first fastening means on said finger exerciser and positioned away from said first moveable member;

d. a second fastening means on said first moveable member;

e. a first tensioning means operatively connecting with said first fastening means and with said second fastening means for resisting movement of said first moveable member;

f. an upright support;

g. a first connecting means operatively connecting said first moveable member to said upright support;

h. said first moveable member being positioned on said first connecting means and being capable of rotating on said first connecting means;

i. a base;

j. a platform mounted on said base;

k. said upright support being mounted on said platform;

l. a hand rest juxtapositioned to said first moveable member;

m. a scale on said upright support;

n. said hand rest having a hand support for receiving a hand and a finger;

o. said first moveable member and said scale being capable of moving with respect to each other;

p. said first finger contact means being of a configuration for receiving a finger and for permitting the finger to rotate said first moveable member;

q. a second finger contact means on said first moveable member;

r. a second hand rest being mounted on said base;

s. said second hand rest having a hand support for receiving a hand and a finger; and, t. said second finger contact means being of a configuration for receiving a finger and for permitting the finger to rotate said first moveable member toward the hand having the finger.

2. A finger exerciser comprising:

a. a first moveable member;

b. a first finger contact means on said first moveable member;

c. a first fastening means on said finger exerciser and positioned away from said first moveable member;

d. a second fastening means on said first moveable member;

e. a first tensioning means operatively connecting with said first fastening means and with said second fastening means for resisting movement of said first moveable member;

f. an upright support;

g. a first connecting means operatively connecting said first moveable member to said upright support;

h. said first moveable member being positioned on said first connecting means and being capable of rotating on said first connecting means;

i. a base;

j. a platform mounted on said base;

k. said upright support being mounted on said platform;

l. a hand rest juxtapositioned to said first moveable member;

m. a scale on said upright support;

n. said hand rest having a hand support for receiving a hand and a finger;

o. said first moveable member and said scale being capable of moving with respect to each other;

p. said first finger contact means being of a configuration for receiving a finger and for permitting the finger to rotate said first moveable member;

q. a second finger contact means on said first moveable member;

r. a second hand rest being mounted on said base;

s. said second hand rest having a hand support for receiving a hand and a finger; and, t. said second finger contact means being of a configuration for receiving a finger and for permitting the finger to rotate said first moveable member away from the hand having the finger.

3. A finger exerciser comprising:

a. a first moveable member;

b. a first finger contact means on said first moveable member;

c. a first fastening means on said finger exerciser and positioned away from said first moveable member;

d. a second fastening means on said first moveable member;

e. a first tensioning means operatively connecting with said first fastening means and with said second fastening means for resisting movement of said first moveable member;

f. an upright support;

g. a first connecting means operatively connecting said first moveable member to said upright support;

h. said first moveable member being positioned on said first connecting means and being capable of rotating on said first connecting means;

i. a base;

j. a platform mounted on said base;

k. said upright support being mounted on said platform;

l. a hand rest juxtapositioned to said first moveable member;

m. a scale on said upright support;

n. said hand rest having a hand support for receiving a hand and a finger;

o. said first moveable member and said scale being capable of moving with respect to each other;

p. said first finger contact means being of a configuration for receiving a finger and for permitting the finger to rotate said first moveable member;

q. said upright support having a first side and a second side;

r. said first connecting means operatively connecting said first moveable member to said upright support on said first side;

s. said first moveable member comprising a first arm and a second arm;

t. said first finger contact means being on said first arm;

u. a second moveable member having a third arm and a fourth arm;

v. a second connecting means operatively connecting said second moveable member to said upright support on said second side;

w. said second moveable member being positioned on said second connecting means and being capable of rotating on said second connecting means;

x. a second finger contact means being on said third arm;

y. a third fastening means on said finger exerciser and being positioned away from said second moveable member;

z. a fourth fastening means on said second moveable member;

aa. a second tensioning means operatively connecting with said third fastening means and with said fourth fastening means for resisting movement of said second moveable member;

bb. said first finger contact means being of a configuration for receiving a finger for moving said first moveable member towards the hand on which the finger is attached; and, cc. said second finger contact means being of a configuration for receiving a finger for moving said second moveable member away from the hand on which the finger is attached.

4. A process for making a finger exerciser, said process comprising:

a. forming a moveable member with a finger contact means;

b. positioning a first fastening means on said finger exerciser and positioned away from said first moveable member;

c. positioning a second fastening means on said first moveable member;

d. operatively connecting a first tensioning means with said first fastening means and with said second fastening means to resist movement of said moveable member;

e. forming an upright support;

f. operatively connecting said moveable member to said upright support;

g. forming a base;

h. mounting a platform on said base;

i. mounting said upright support on said platform;

j. mounting a hand rest on said base;

k. juxtapositioning said hand rest to said moveable member;

l. mounting a guide on said base and operatively connecting said guide and said platform to allow movement of said platform and said upright support with respect to said hand rest;

m. forming a scale on said upright support;

n. positioning a finger contact means on said moveable member;

o. forming said finger contact means of a configuration for receiving and for permitting a finger to rotate said moveable member;

p. mounting a second hand rest on said base;

q. juxtapositioning said second hand rest to said moveable member; and, r. configuring said finger contact means for receiving a finger and for permitting a finger to rotate said moveable member toward the hand having the finger.

5. A process for making a finger exerciser according to claim 4, said process comprising:

a. forming an upright support to have a first side and a second side;

b. operatively connecting said moveable member, by a connecting means, to said upright support on said first side;

c. positioning said moveable member on said connecting means to be capable of rotating on said connecting means;

d. identifying said moveable member as a first moveable member;

e. forming said first moveable member with a first arm and a second arm;

f. positioning said first finger contact means on said first arm;

g. operatively connecting said first tensioning means with said upright support and with said first arm;

h. selecting a second moveable member having a third arm and a fourth arm;

i. operatively connecting said second moveable member, by a second connecting means, to said upright support on said second side;

j. positioning said second moveable member on said second connecting means to be capable of rotating on said second connecting means;

k. positioning a second finger contact means on said third arm;

l. operatively connecting a second tensioning means with said upright support and with said third arm;

m. forming said first finger contact means to be capable of receiving a finger for moving said first moveable member towards the hand on which the finger is attached; and, n. forming said second finger contact means to be capable of receiving a finger for moving said second moveable member away from the hand on which the finger is attached.

6. A process for making a finger exerciser, said process comprising:

a. forming a moveable member with a finger contact means;

b. positioning a first fastening means on said finger exerciser and positioned away from said first moveable member;

c. positioning a second fastening means on said first moveable member;

d. operatively connecting a first tensioning means with said first fastening means and with said second fastening means to resist movement of said moveable member;

e. forming an upright support;

f. operatively connecting said moveable member to said upright support;

g. forming a base;

h. mounting a platform on said base;

i. mounting said upright support on said platform;

j. mounting a hand rest on said base;

k. juxtapositioning said hand rest to said moveable member;

l. mounting a guide on said base and operatively connecting said guide and said platform to allow movement of said platform and said upright support with respect to said hand rest;

m. forming a scale on said upright support;

n. positioning a finger contact means on said moveable member;

o. forming said finger contact means of a configuration for receiving and for permitting a finger to rotate said moveable member;

p. a second finger contact means on said moveable member;

r. a second hand rest being mounted on said base;

s. said hand rest having a hand support for receiving a hand and a finger; and, t. configuring said finger contact means for receiving a finger and for permitting a finger to rotate said moveable member away from the hand having the finger.

* * * * *